United States Patent [19]

Baumann et al.

[11] 4,186,633

[45] Feb. 5, 1980

[54] APPARATUS FOR DISPENSING SHEETS OF WEB MATERIAL OF PREDETERMINED LENGTH

[75] Inventors: Manfred Baumann; Walter Besserer, both of Diepoldsau, Switzerland

[73] Assignee: Apura GmbH, Mainz-Kostheim, Fed. Rep. of Germany

[21] Appl. No.: 897,453

[22] Filed: Apr. 18, 1978

[30] Foreign Application Priority Data

Apr. 19, 1977 [CH] Switzerland ..... 004859/77

[51] Int. Cl.[2] ..... B65H 35/08

[52] U.S. Cl. ..... 83/155; 83/308; 83/310; 83/331; 83/334; 83/347; 83/358; 83/649

[58] Field of Search ..... 83/155, 331, 334, 335, 83/337, 322, 308, 358, 359, 310, 114, 649; 225/15, 90

[56] References Cited

U.S. PATENT DOCUMENTS

| | | | |
|---|---|---|---|
| 764,806 | 7/1904 | Ham | 83/322 |
| 1,553,331 | 9/1925 | Shelley | 83/334 |
| 2,051,242 | 8/1936 | Birr et al. | 83/322 X |
| 2,560,061 | 7/1951 | Agamaite | 83/322 |
| 3,739,965 | 6/1973 | Jespersen | 83/334 |

*Primary Examiner*—J. M. Meister

*Attorney, Agent, or Firm*—Sughrue, Rothwell, Mion, Zinn and Macpeak

[57] ABSTRACT

A dispenser for sheets of web material, such as paper towels, from a supply roll, including a housing, means for holding a supply roll of the web material, and means for separating a sheet of the web from the supply roll operable in response to a user pulling the sheet from the housing and arranged to present at least a portion of the leading edge of the web ready for a user to seize for the dispensing of a further sheet as a direct result of the user pulling the previous sheet from the dispenser.

16 Claims, 22 Drawing Figures

Fig.1
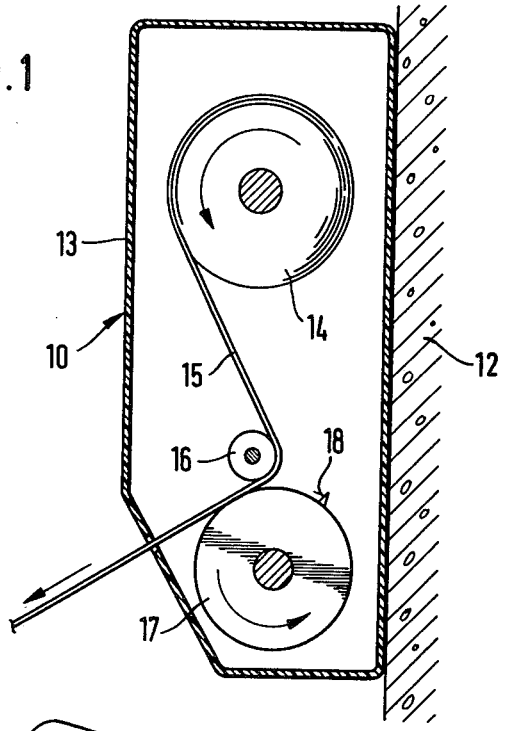
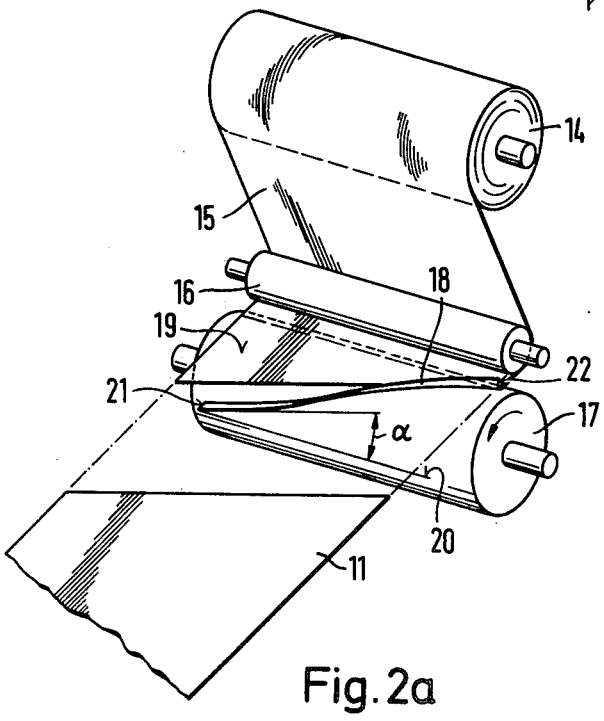
Fig.2a
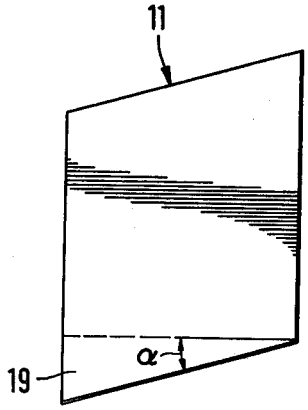
Fig.2b

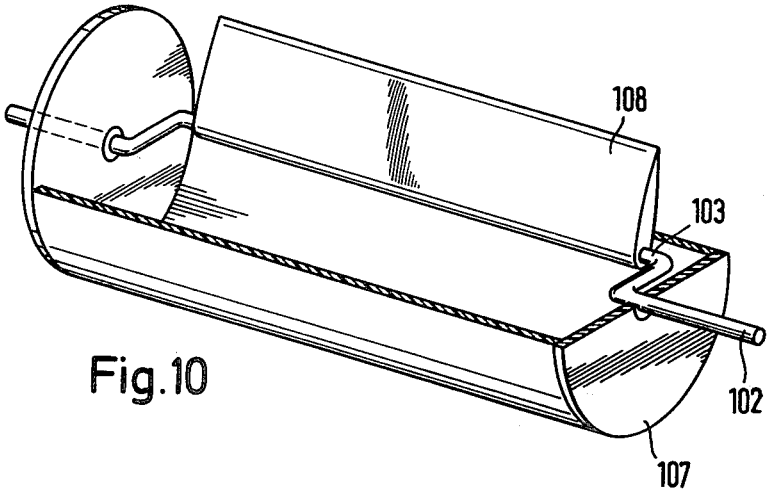
Fig.10
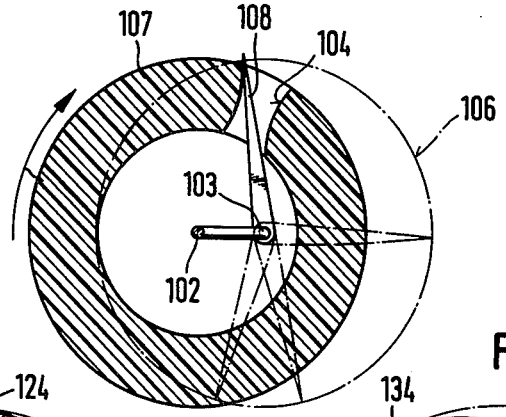
Fig.11
Fig.12
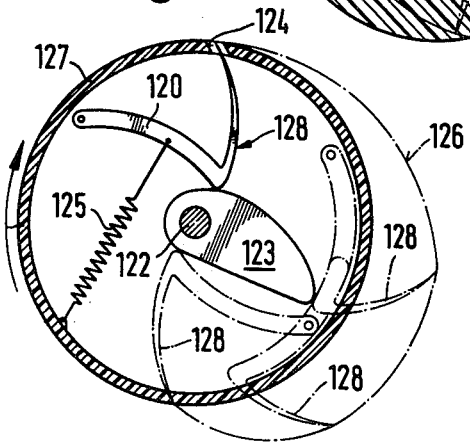
Fig.13
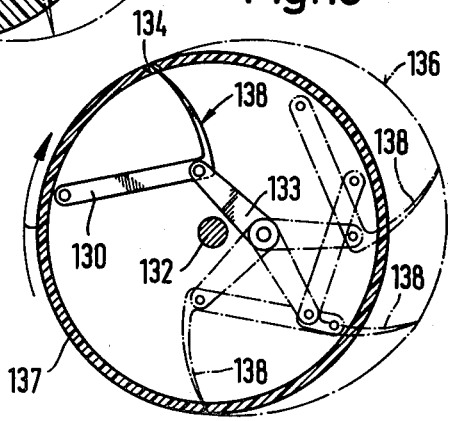

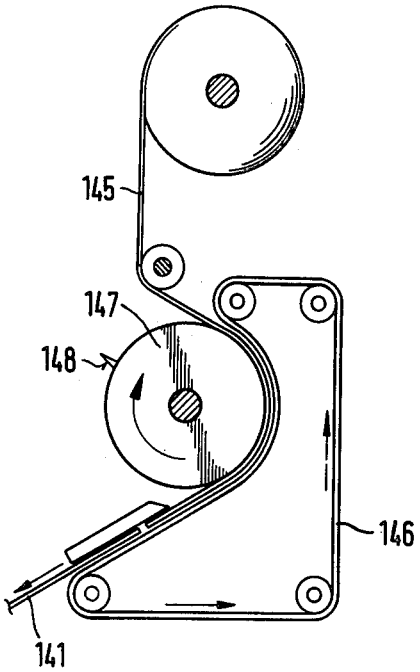
Fig.14
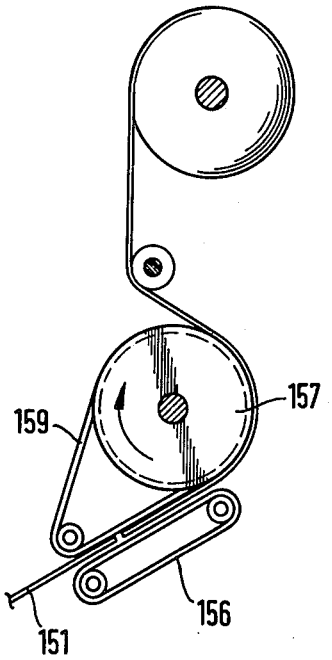
Fig.15
Fig.16
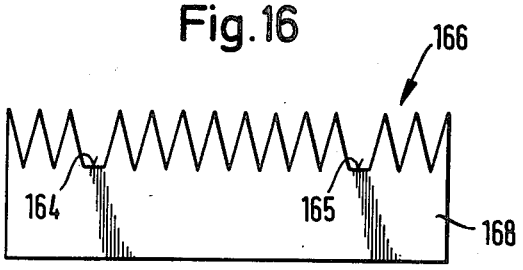

APPARATUS FOR DISPENSING SHEETS OF WEB MATERIAL OF PREDETERMINED LENGTH

BACKGROUND OF THE INVENTION

The invention relates to an apparatus for dispensing pieces of paper or like web material of predetermined length from a supply such as a roll of the web material, having a device, operable by pulling on the free end of the paper web, for parting the pieces of paper from the paper web and for presenting the fresh end of the paper web ready to be seized, after the parted piece of paper has been released.

In known apparatus of this kind, when a piece of paper is pulled out, which is parted from the following paper web by a stationary or moving blade, use is made of a suitable device, for instance, two inter-engaging suction cups, to store energy briefly. The stored energy is then released to push the following end of the paper web out of the apparatus, ready to be seized for the next dispensing operation, when the previously parted piece of paper has been released. This prior art apparatus has been very elaborate and therefore relatively expensive and unreliable.

It is an object of the invention to provide a simply constructed apparatus which, after a piece of paper has been dispensed, reliably makes the following fresh end of the paper web automatically ready to be seized for the next dispensing operation.

SUMMARY OF THE INVENTION

Accordingly the present invention provides an apparatus for dispensing sheets of web material of predetermined length from a supply of the web material comprising: a housing, means for storing the supply of web material in the housing, and separating means arranged in the housing and operable in response to a user of the apparatus pulling from the housing the free end of web material in the storing means, to separate a sheet of the web material from the remainder, the separating means comprising a roller mounted for rotation in the housing, means for guiding the free end of the web over the roller as it is pulled from the housing, and cutting means arranged on the surface of the roller to give a cutting line at least part of which extends at an angle other than zero to the axis of the roller, whereby when a sheet of the web has been taken by the user, a portion of the leading edge of the remainder of the web has advanced outside the housing to be available for gripping by a subsequent user. According to the invention, therefore, a single, simply constructed and absolutely reliable device simultaneously parts a piece of paper from the paper web and provides the following end of the web ready to seize, since, due to the cutting line of the bladed roller, the following end of the paper web which is the start of the following sheet of paper automatically and without any delay projects out of the apparatus ready to seize, when the parted piece of paper has left the apparatus.

Bladed rollers with oblique cutting lines for paper dispensing apparatuses are known per se, see for instance U.S. Pat. Nos. 454,316; 1,835,439 and 2,278,029, but these prior art apparatuses require additional expensive devices and steps to make the following end of the paper web ready for seizing.

According to a further aspect the present invention provides an apparatus for dispensing sheets of web material of predetermined length from a supply of the web material comprising: a housing, means for storing the supply of web material in the housing, separating means comprising a bladed roller having a width at least equal to the width of the web material arranged in the housing and operable in response to a user of the apparatus pulling from the housing the free end of the web material in the storing means, to separate a sheet of the web material from the remainder and to leave at least a portion of the leading edge of the remainder of the web available to be gripped by a subsequent user, conveying means arranged to engage the web over a part of its width, non-positive drive means operable between the bladed roller and the conveying means, and a pressure device arranged to urge the web into engagement with the conveyor means.

This simply constructed and reliable device can produce any desired cutting line in the paper web—i.e. even a cutting line extending parallel with the axis of the roller. In this case the following end of the paper web is made ready to seize after the release of the parted piece of paper by the feature that, even after the piece of paper to be dispensed has been completely parted, the pull exerted on such parted sheet of paper is also exerted by means of the pressure device urging the sheet into engagement with the conveying means and the conveying means being connected to the bladed roller, on the following paper web until the parted piece of paper has left the apparatus. Since the conveying device is substantially narrower than the bladed roller, at that moment the following end of the paper web is directly available to be seized for the following operation of dispensing a piece of paper.

The non-positive connection between the conveyor means and the bladed roller can be, for instance, a frictional connection, and the conveyor means can take the form, for instance, of an endless belt or a roller, the pressure device taking the form of a wedge, brush, spring, stationary or synchronised endless belt, or the like. If the pressure device is in the form of an endless belt, it may be guided around the bladed roller. As a result, strictly speaking the pressure device may be considered as performing the functions of the conveying device, and the conveying device may be considered as performing the functions of the pressure device.

BRIEF DESCRIPTION OF THE DRAWINGS

Other features, advantages and possible uses of the invention can be gathered from the following description of embodiments thereof, in conjunction with the drawings, wherein:

FIG. 1 is a longitudinal section through a first embodiment of the invention;

FIG. 2*a* is a perspective view of the apparatus illustrated in FIG. 1 without its casing;

FIG. 2*b* shows a piece of paper delivered by the apparatus illustrated in FIG. 2*a;*

FIG. 10 is a partially broken-away perspective view of a first embodiment of the bladed roller for the apparatus illustrated in FIGS. 8 and 9, FIG. 11 is a longitudinal section through the bladed roller illustrated in FIG. 10, showing in chain lines different positions of the blade in the cutting zone;

FIG. 12 is a longitudinal section through another embodiment of the bladed roller, showing in chain dot lines different positions of the blade in the cutting zone;

FIG. 13 is a longitudinal section through yet another embodiment of the bladed roller, showing in chain lines different positions of the blade in the cutting zone;

FIG. 14 is a longitudinal section through a further embodiment of the invention, with a variant construction of the conveying device;

FIG. 15 is a longitudinal section through a further embodiment of the invention, with a variant embodiment of the pressure device, and FIG. 16 is a side elevation of a construction of a blade for various of the embodiments of the invention.

FIG. 1 shows a dispenser apparatus 10 for dispensing sheets of paper, the dispenser having, for instance, a casing 13 arranged to be attached to a wall 12, means for holding a roll 14 of a paper web 15, a guide roller 16 and a bladed roller 17. As can be seen more particularly from the perspective view in FIG. 2*a*, the bladed roller 17 has, for instance, a fixed cutting blade 18 which extends helically over substantially the whole roller width and extends out of the roller surface. The cutting line of the blade 18 thus forms with the axis of the roller, or with a generatrix 20 of the roller surface, an angle $\alpha$ corresponding to the pitch angle of the helical cutting line. The bladed roller 17 is rotated by frictional engagement with the web as a user pulls the end of the web 15 out of the housing. As soon as the blade 18 engages the web 15, which is stretched tight by means of the guide roller 16, at the end 21 of the blade (shown on the left in FIG. 2*a*), a sheet 11 of the web starts to be parted from the following web 15. The parting operation is completed only when the other end 22 of blade 18 (shown on the right in FIG. 2*a*) engages with the web and a sheet 19 of the following web has emerged from the dispenser housing and is ready to be seized by a user for the following dispensing operation.

FIG. 3*a* shows a bladed roller 37 for use in the above dispenser having a "herring bone" blade 38 which extends helically with a left-handed thread over one half of the roller and with a right-handed thread over its other half. The sheet 31 of paper produced by the blade 38 is shown in FIG. 3*b*, and the remaining web is left with a tongue 39 ready to be seized by a user for pulling out a further piece of web.

FIG. 4*a* shows a further bladed roller 47 which may be used, having a blade 48 at which has parts 48 extending parallel with the axis of the roller and parts **48*b* extending at right angles to such axis. The sheet 41** of paper produced by the blade is shown in FIG. 4*b*, with the tongue 49 ready to seize for pulling out such sheet of paper 41.

Figure 3A:
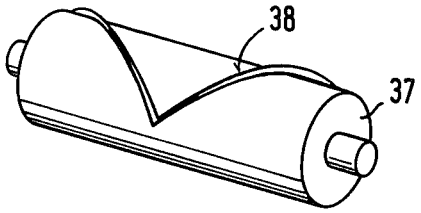
FIGS. 3*a* and 3*b* illustrate a first modified embodiment of the bladed roller, and a corresponding piece of paper cut thereby, respectively.
Figure 3B:
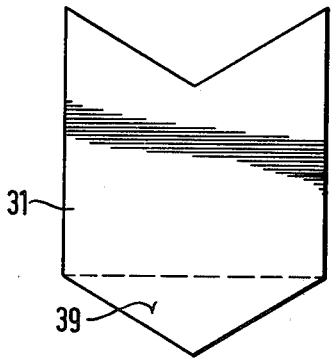
Figure 4A:
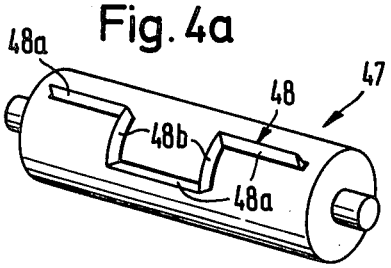
FIGS. 4*a* and 4*b* illustrate a second modified embodiment of the bladed roller and a corresponding piece of paper cut thereby, respectively.
Figure 4B:
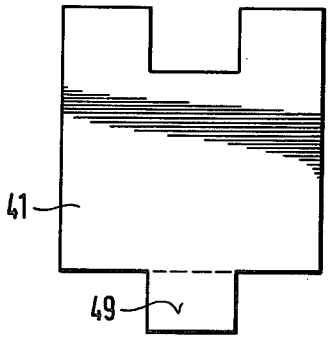

The blades illustrated in FIGS. 2*a*, 3*a* and 4*a* are merely exemplary advantageous constructions. The blades can be arranged as required over the roller generated surface, as long as the basic condition is met that at least part of their cutting line forms with the axis of the bladed roller an angle differing from zero, so that an adequate piece of the following paper web is left ready to seize for the following paper dispensing operation, when a sheet of paper just dispensed has been parted from the following paper web.

Figure 5A:
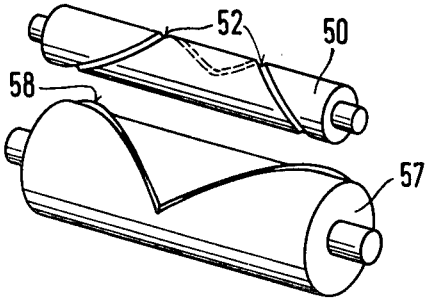
FIG. 5*a* shows a pair of cutting rollers according to a third modified embodiment.
Figure 5B:
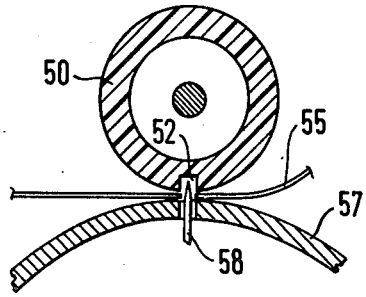
FIG. 5*b* shows a cross-section of the rollers of FIG. 5*a* in cooperative engagement.

FIGS. 5*a* and 5*b* show a further example 57 of a bladed roller which may be used to make the blade cutting operation even more reliable, a backing roller 50 being provided which is formed with a groove 52 matching the blade 58 on the blade roller. The two rollers 57, 50 are drivably connected via two gearwheels (not shown) whose pitch diameters correspond to the respective roller diameters and which cause the rollers to move synchronously so that the blade 58 pierces the paper web indicated at 55, as it is stretched tightly over the groove 52 in the roller 50; the blade 58 penetrating the groove 52 for this cutting operation, as shown particularly clearly in FIG. 5*b*.

Figure 6A:
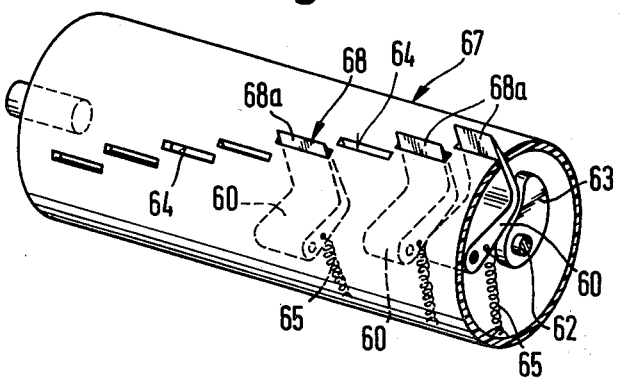
FIGS. 6*a* and 6*b* illustrate a fourth modified embodiment of the bladed roller and a corresponding piece of paper cut thereby, respectively.
Figure 6B:
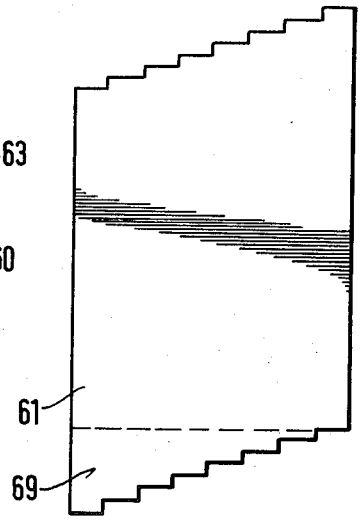

FIG. 6*a* shows a further bladed roller 67 which may be used having a blade 68 consisting of a number of parts **68*a* offset in relation to one another in the peripheral direction of the roller so that they together give a generally helical cutting line. Each of the blade parts 68*a* is disposed at the end of a lever 60 which is pivotably mounted on the inside wall of the roller 67. For each lever 60 a cam disc 63 is attached to a stationary spindle 62 which also forms a support for the roller 67. When the roller 67 rotates—i.e., when the paper web is pulled out of the apparatus—the blade parts 68*a* are moved in a predetermined sequence through slots 64 formed in the roller surface for the cutting operation on the sheet of paper concerned. The movement of the blade parts 68*a* is in each case controlled by the respective cam disc 63. To stabilize the movement of the blade parts 68*a*, more particularly for their path of movement inside the roller, a spring as shown at 65, can be provided operative between each lever 62 and the inside wall of the roller 67. The path of movement of the blade parts 68*a* can also be stabilized in this way by a suitable design of part of the cam discs 63 which controls that part of the path of movement of the blade parts 68*a*** which occurs inside the roller. FIG. 6*b* shows the sheet 61 of paper produced by the blade 68 illustrated in FIG. 6*a*, which leaves the part 69 of the remaining paper ready to be seized.

Figure 7A:
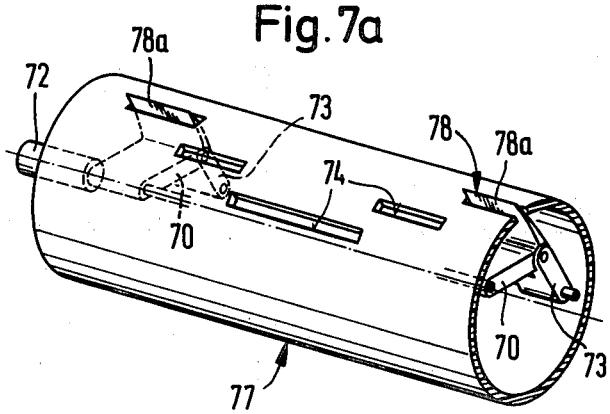
FIGS. 7*a* and 7*b* illustrate a fifth modified embodiment of the bladed roller and a corresponding piece of paper cut thereby, respectively.
Figure 7B:
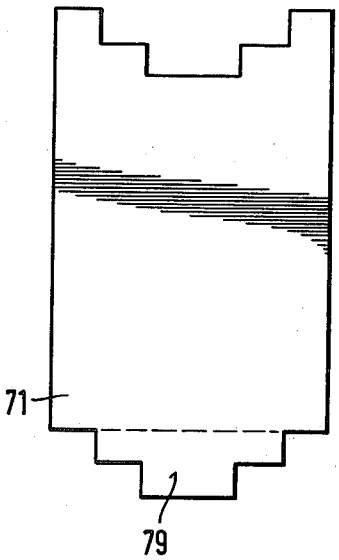

FIG. 7 shows a further construction of a bladed roller which may be used having a blade 78 which also comprises a number of parts **78*a*, generally corresponding to the parts 68*a*** of the blade illustrated in FIG. 6*a*. In the embodiment illustrated in FIG. 7*a* blade parts **78*a* are each disposed at the end of a lever 70, all the levers being mounted on the inside wall of the roller 77. The movement of the blade parts 78*a* through the slots 74 in the roller surface is controlled in this embodiment by means of levers 73 which are mounted eccentrically of the roller spindle 72 and are each articulated to the levers 70**. FIG. 7*b* shows the sheet 71 of paper produced by the blade 78 illustrated in FIG. 7*a*, which leaves the tongue 79 of paper ready to be seized.

Figure 8:
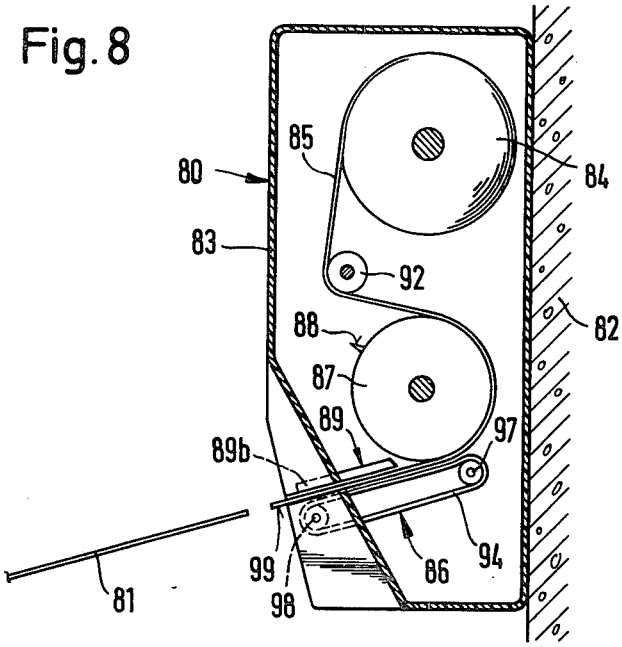
FIG. 8 is a longitudinal section through a second embodiment of the invention.

FIG. 8 shows a further dispenser apparatus 80 for dispensing sheets 81 of paper, the dispenser having, for instance, a housing 83 arranged to be attached to a wall 82, means for carrying a roll 84 of a paper web 85, a guide roller 92, a bladed roller 87, a conveying device 86 and a pressure device 89.

FIGS. 10–13 illustrate various embodiments of the arrangement and control of the blade of the bladed roller for use in the further dispenser 80. Basically in the dispenser 80 it is preferred to use one-part blades but operated in a similar manner to the blade portions shown for the first apparatus 10 in FIGS. *6a* and *7a*.

The one-part full width blade 128 (shown in FIG. 12) basically corresponds to a portion of the multi-part blade 68 illustrated in FIG. *6a*. The blade 128 is therefore disposed at the end of a lever 120 pivotably mounted on the inside wall of roller 127. Attached to the stationary spindle 122 of roller 127 is a cam disc 123 engaging with the lever 120. When the roller 127 is rotated, the blade 128 is moved outwardly in the cutting zone through a slot 124 formed in the roller surface. During the cutting operation the cutting edge of the blade 128 passes through a path of movement 126, three different positions of the lever 20 and blade 128 being shown in FIG. 12 in chain dot lines. A spring 125 can be arranged, for instance, operative between the lever 120 and the inside wall of roller 127, to stabilize the path of movement of the blade.

The one-part full width blade 138, shown in FIG. 13, corresponds to a portion of the multi-part blade 78 illustrated in FIG. *7a*. Consequently the blade 138 is disposed at the end of a lever 130 mounted on the inside wall of the roller 137. The blade 138 is controlled in its movement through a slot 134 formed in the roller surface by means of a lever 133 which is mounted eccentrically of the roller spindle 132 and is articulated to the lever 130. During the cutting operation the cutting edge of the blade 138 passes through a path of movement 136, three different positions of the lever arrangement 130, 133 and blade 138 being shown in FIG. 13 in chain dot lines.

FIGS. 10 and 11 show another embodiment of the bladed roller which may be used in the dispenser 80. In this arrangement a blade 108 is pivotably mounted inside the roller 107 on a spindle 103 which is disposed eccentrically of the roller spindle 102 and formed integrally therewith, blade being entrained through a slot 104 formed in the roller surface as the roller 107 rotates. The cutting edge of the blade 108 describes a path of movement 106 as the roller rotates, three different positions of the blade 108 being shown in chain dot lines in FIG. 11. The depth of the blade 108 corresponds substantially to the radius of the roller 107 plus the eccentricity of the spindle 103 in relation to the spindle 102, so that the blade is entrained by the slot 104 over its whole path of movement.

Figure 9:
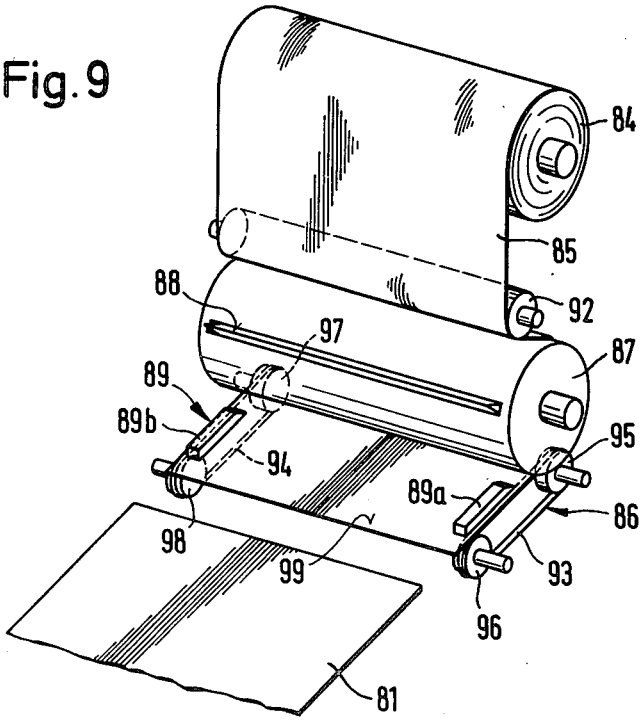
FIG. 9 is a perspective view of the apparatus illustrated in FIG. 8, without its casing.

The conveying device 86 illustrated in FIGS. 8 and 9 engages the web over a substantially narrower width than the bladed roller 87 and consists of two endless belts 93, 94, respectively guided around pairs of rollers 95, 96; 97, 98 and disposed respectively at the edge zones of the bladed roller 87. The portion 99 of the paper web 85 which is between the two belts is ready to seize, for a subsequent paper dispensing operation, when the sheet 81 of paper has been dispensed, since in the region above the portion 99 of paper lies, the casing 83 is correspondingly cut away and the rollers 95, 96; 97, 98 and the belts 93 and 94 are mounted to the sides.

When a sheet of paper is separated from the remainder of the web, and pulled out of the apparatus, it held in engagement with the conveyor means formed by the belts 93 and 94 by action of the pressure devices 89. There is also provided a non-positive drive between the conveyor means and the bladed roller 87. Thus as the separated sheet is pulled out the conveyor means and the bladed rollers are driven, and in turn the leading edge of the remainder of the web is also driven out following closely behind the separated sheet as it is pulled out. As a result, the fresh leading edge of web is presented ready to be seized for a subsequent paper dispensing operation.

Of course, other conveying devices could be used as substitutes for the conveying device 86 constructed as illustrated in FIG. 9. For instance, a single endless belt could be arranged in the centre of the roller, the result being that the fresh leading edge of the web is presented ready to seize on the right and left of the single belt. The conveying device can also comprise relatively large rollers. Moreover, a conveying device 146 shown in FIG. 14 consisting of one or two belts can be partially guided around the bladed roller 147, to press the paper web 145 against the bladed roller 147 in the cutting zone and therefore improve the cutting operation. Instead of the conveying belt partially guided around the bladed roller, a device (not shown) which is stationary in relation to the roller can be provided to press the paper web against the roller in the cutting zone.

For every construction and arrangement of the conveyor means it is essential that there should be a non-positive driving connection between the conveyor means and the bladed roller, for instance, by frictional connection, as in the belt construction illustrated in FIGS. 8, 9 and 14, and/or, for instance in an arrangement which is not shown, with a drive optionally including gear wheels between the rollers 95, 97 and the bladed roller 87.

The pressure device 89 shown in FIGS. 8 and 9 consists of two stationary wedges 89*a*, 89*b* which are in resilient frictional engagement with belts 93, 94. Instead of the wedges, use can also be made of brushes, springs, stationary belts or belts co-rotating with the paper web, or the like. The essential thing is always that there must be frictional engagement between the web and the conveying means.

In the embodiment illustrated in FIG. 15 the pressure device comprises one or two endless belts 159 which are guided over the bladed roller 157. In this construction the pressure device 159 performs functions of the conveying means, since it is drivably but non-positively connected to the bladed roller, while the conveying means in the form of a belt or belts 156 performs functions of the pressure device.

In all the above arrangements the association between the bladed roller, the conveyor means and the pressure device must be such that when the sheet of paper to be dispensed is parted from the following paper web, the force exerted on the sheet of paper already parted is transmitted to the following paper web until the latter has been pulled along into the position in which its leading edge is ready to be seized for the following dispensing operation.

FIG. 16 shows an advantageous serrated cutting edge 166 of a blade 168 for the bladed roller. The blade 168 also has cut away portions 164, 165 through which, for instance, the conveying belts 93, 94 (FIG. 9) may pass. Such cut away portions are provided in the blade for all those parts of the pressure device and/or the conveying means which extend into the zone of the path of movement of the blade.

What is claimed is:

1. An apparatus for dispensing sheets of web material of predetermined length from a supply of the web material comprising:

a housing;

means for storing the supply of web material in the housing, separating means comprising a bladed roller having thereon a blade having a width at least equal to the width of the web material arranged in the housing and operable in response to a user of the apparatus pulling from the housing the free end of web material in the storing means, to separate a sheet of the web material from the remainder and to leave at least a portion of the leading edge of the remainder of the web available to be gripped by a subsequent user, conveying means arranged to engage the web over a part of its width, non-positive drive means operable between the bladed roller and the conveying means, and a pressure device arranged to urge the web into engagement with the conveyor means.

2. An apparatus according to claim 1, wherein the blade roller has therein a spindle eccentrically mounted with respect to the axis of the roller, and the blade is pivotally mounted on that spindle and is guided by a slot in the roller surface as the bladed roller rotates about its axis.

3. An apparatus according to claim 1, wherein the bladed roller has a lever pivotally mounted therein and the blade is mounted on that lever, and an operating device is provided to engage the lever and cause the blade to emerge through a slot formed in the roller surface as the roller rotates about its axis.

4. An apparatus according to claim 3, wherein the operating device comprises a cam disc attached to the roller spindle.

5. An apparatus according to claim 3, wherein the lever is resiliently biased by means of a spring operative between it and the inside wall of the roller.

6. An apparatus according to claim 3, wherein operating device comprises a second lever pivotally mounted eccentrically of the roller spindle and articulated to the lever.

7. An apparatus according to claim 1, wherein the conveyor means comprises an endless belt.

8. An apparatus according to claim 1 wherein the conveyor means comprises two endless belts disposed one at each side of the bladed roller.

9. An apparatus according to claim 1, wherein the conveyor means comprises a single endless belt disposed at the centre of the bladed roller.

10. An apparatus according to claim 7, wherein the belts extend partially around the bladed roller.

11. An apparatus according to claim 1, wherein the conveying means comprises a roller.

12. An apparatus according to claim 1, wherein the blade has a serrated cutting edge.

13. An apparatus according to claim 1, wherein the pressure device is stationary in the housing.

14. An apparatus according to claim 1, wherein the blade has cut away portions to clear any part of the conveyor means and the pressure device.

15. An apparatus according to claim 1, wherein the pressure device comprises an endless belt moved synchronously with the conveyor means.

16. An apparatus according to claim 1, wherein the pressure device comprises an endless belt guided around the bladed roller.

* * * * *